US011385014B2

(12) United States Patent
Klein et al.

(10) Patent No.: US 11,385,014 B2
(45) Date of Patent: Jul. 12, 2022

(54) WEAPON TESTING AND VERIFICATION CHAMBER

(71) Applicant: Rampart International, Ottawa (CA)

(72) Inventors: Mike Klein, Ottawa (CA); Luc Lalonde, Milton (CA)

(73) Assignee: Rampart International, Ontario (CA)

( * ) Notice: Subject to any disclaimer, the term of this patent is extended or adjusted under 35 U.S.C. 154(b) by 245 days.

(21) Appl. No.: 16/875,471

(22) Filed: May 15, 2020

(65) Prior Publication Data

US 2021/0356227 A1 Nov. 18, 2021

(51) Int. Cl.
*F41J 13/00* (2009.01)
*F41A 31/00* (2006.01)
*F41H 13/00* (2006.01)

(52) U.S. Cl.
CPC ..... *F41A 31/00* (2013.01); *F41H 13/0012* (2013.01); *F41J 13/00* (2013.01)

(58) Field of Classification Search
CPC ..... F41J 13/00; F41A 31/00
See application file for complete search history.

(56) References Cited

U.S. PATENT DOCUMENTS 3,944,227 A * 3/1976 Nilsson ..... A63B 63/00 273/410
7,163,205 B1 1/2007 Kecskes et al.
7,280,340 B2 10/2007 Smith et al.
8,428,899 B2 4/2013 Miller et al.
9,008,838 B2 4/2015 Geidek
10,030,945 B1 * 7/2018 Mol ..... F41J 13/00
2012/0187631 A1 * 7/2012 John ..... F41J 13/00 273/410
2016/0116260 A1 * 4/2016 Oh ..... F41J 13/00 273/410
2019/0234715 A1 * 8/2019 Yang ..... F41J 11/02

FOREIGN PATENT DOCUMENTS

WO 2017/070788 A1 5/2017

OTHER PUBLICATIONS

International Search Report for PCT Application No. PCT/CA2016/051249; Canadian Intellectual Property Office; Gatineau, Quebec, Canada; dated Feb. 10, 2017.

* cited by examiner

*Primary Examiner* — J. Woodrow Eldred
(74) *Attorney, Agent, or Firm* — Thomas E. Lees, LLC

(57) ABSTRACT

A weapon testing chamber is provided. The chamber enables the testing of conducted energy weapon (CEW) and contain any accidental discharges which may occur. In addition the chamber may also be utilized for safe unloading of a handgun by providing a testing chamber which can absorb any accidental discharges of the firearm and can accommodate differing models and types of weapons in a single testing chamber.

19 Claims, 12 Drawing Sheets

WEAPON TESTING AND VERIFICATION CHAMBER

TECHNICAL FIELD

The present disclosure relates to weapons testing and verification, and in particular to the safe testing of the operation, discharging or unloading of a weapon.

BACKGROUND

Conducted energy weapons or conducted electrical weapons (CEW) have become prevalent tools by law enforcement agencies. CEWs are devices that use electrical energy to induce pain or to immobilize or incapacitate a person. Prior to starting a shift officers can be required to verify the operation of their CEW to ensure proper charge and operation. During this testing the CEW may inadvertently discharge the barbed darts of the CEW causing damage or injury to the operator. As disclosed in Canadian Patent No. 3,042,331 A1, commonly owned by the Applicant, the camber can provide a means of testing the operation a weapon while limiting the impact of possible inadvertent discharge to the operator or surrounding area. Similarly advertent discharge of a firearm such as a handgun can occur during verification that the weapon chamber. In an enclosed environment an accidental discharge can have deadly consequences.

Accordingly, there is a need for an improved device that enables safe testing or unloading of weapons by ensuring that an accidental discharge does not occur.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The invention will now be described in detail with reference to various embodiments thereof as illustrated in the accompanying drawings. Specific details are set forth in order to provide a thorough understanding of the invention. It will be apparent to one skilled in the art that the invention may be practiced without using some of the implementation details set forth herein. It should also be understood that well known operations have not been described in detail in order to not unnecessarily obscure the invention. Embodiments are described below, by way of example only, with reference to FIGS. 1-14.

One general aspect includes a weapon testing chamber comprising a plurality of sides forming a chamber; a removable cover on one side of the chamber, having an opening there through, for receiving an operative end of a weapon pointed into the chamber, the removable cover retained by at least two sides of the plurality of sides forming the chamber having respective receiving slots provided therein; an absorption surface opposite of the cover within the chamber on at least one of the plurality of sides for receiving or absorbing a projectile if propelled from the weapon; and a reflective surface within the chamber to enable an operator to view an end of the weapon inserted within the opening; where the absorption surface contains the projectile when discharged from the weapon and the removable cover can be removed by to retrieve the projectiles.

The weapons testing chamber may also be required to accommodate different types and models of weapons, each having different end profiles. Having dedicated chambers to each type of weapon can consumer significant amount of space and a particular chamber may be used with an unintended weapon type. The ability to easily accommodate different weapon models and even different weapon types, such as CEW or handguns with one chamber is advantageous. An interchangeable cover allows a single chamber to accommodate multiple weapon types while ensure safe use of the testing chamber.

Figure 1:
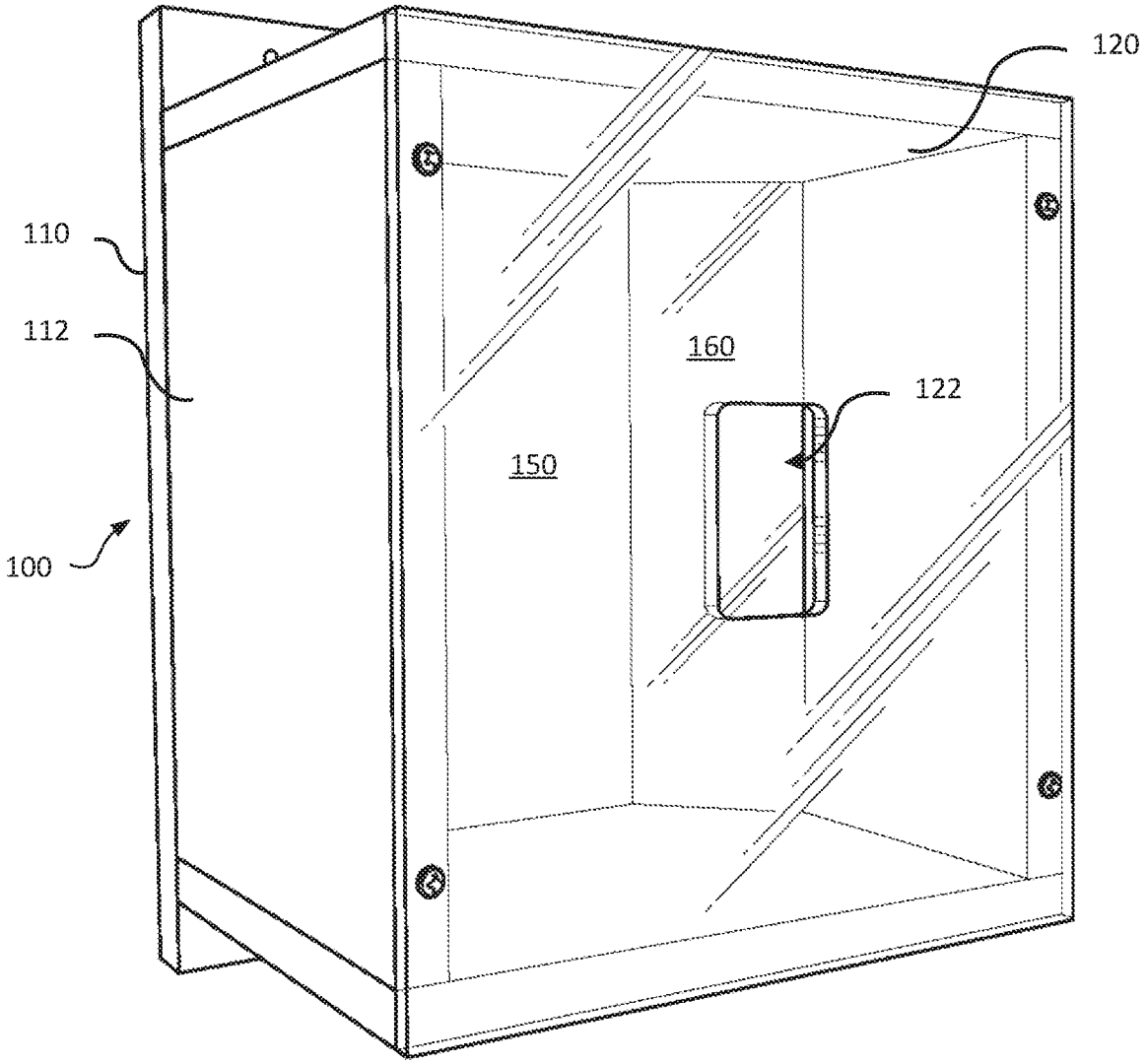
FIG. 1 shows a front perspective view of the conducted energy weapon testing chamber.

FIG. 1 shows a front perspective view of the conducted energy weapon (CEW) testing chamber 100. The CEW testing chamber 100 having at least one viewing cover 120 at least a portion of which providing transparent pane such as Plexiglas to enable the operator to view the discharge of the CEW which can be placed in opening 122. The interior of the CEW testing chamber 100 has reflective surface 160, such as a mirror, which can be angled to allow the operator to view the discharge of the CEW. The reflective surface can be made of a reflective acrylic surface or any reflective surface that can withstand the impact of a dart. An absorption surface 150 at the back of the chamber can be a material or surface which can absorb the impacted of barbed darts when discharged from the CEW. The absorption surface may comprises one or more layers. One layer can be a fabric to capture the barbs or probes, second layer can be provided to absorb and dissipate the impact of the barb such as but not limited to nylon, Kevlar™, rubber, Cordura® or foam. The viewing cover 122 is surrounded by sides 112 including a rear surface 110. The viewing cover 120 may further include a hinge at an edge surface connected to one of the sides 112 to allow easy access to the interior of the CEW testing chamber 100. A retaining mechanism such as a clip or latch can be provided on one or more of the unhinged sides. Alternatively the viewing cover may slide into slots formed on the interior of the chamber or at the edges of the sides 112, wherein the viewing cover can be slid up or to a side to access the interior of the chamber 100.

Figure 3:
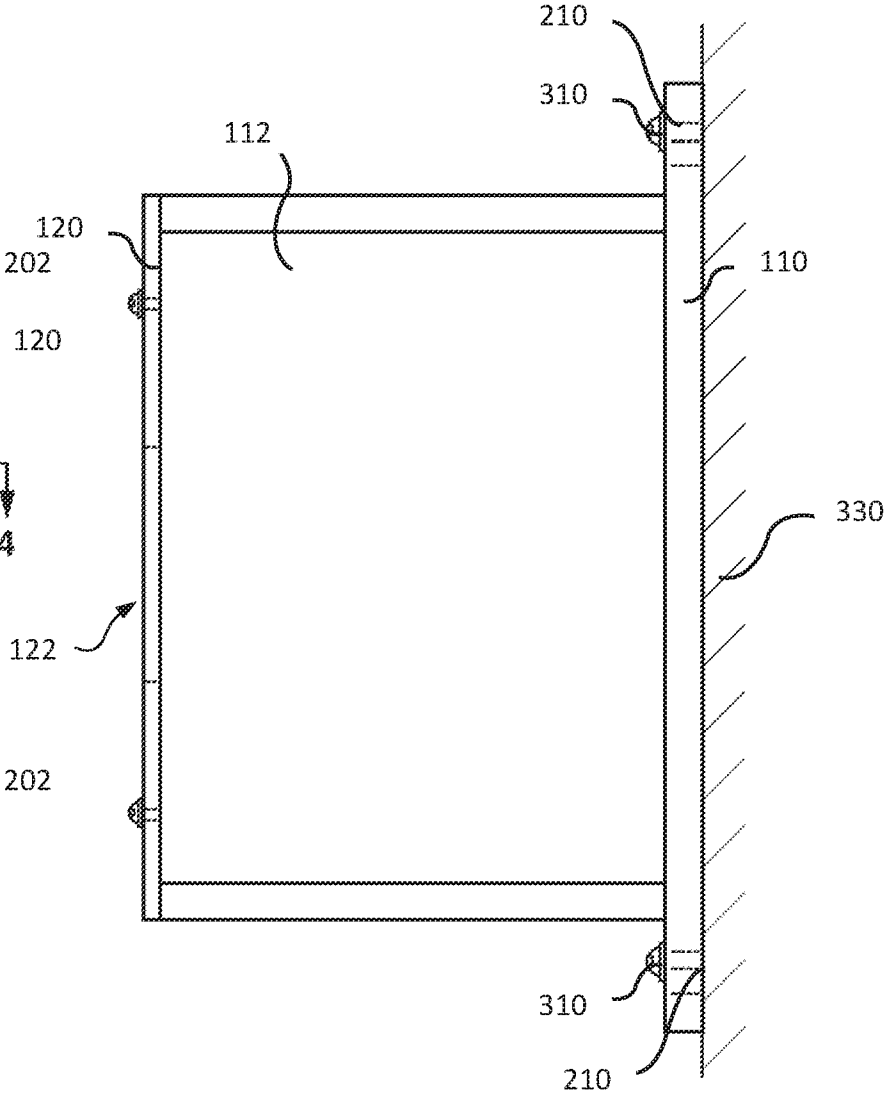
FIG. 3 shows a side view of the conducted energy weapon testing chamber.
Figure 2:
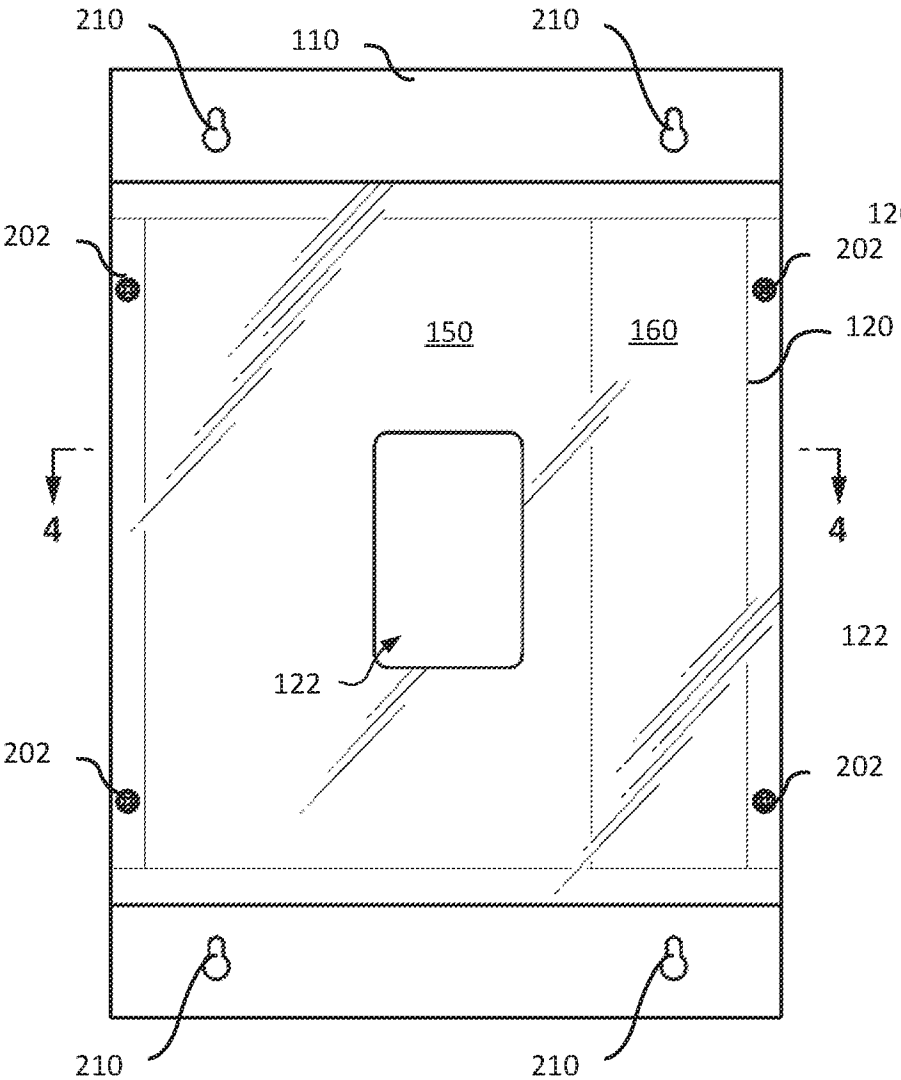
FIG. 2 shows a front view of the conducted energy weapon testing chamber.

Referring to FIGS. 2 and 3 where FIG. 2 shows a front view of the conducted energy weapon testing chamber 100 and FIG. 3 shows a side view of the conducted energy weapon testing chamber 100. The viewing cover 120 can be secured or retained by fasteners 202 to sides 112. The viewing cover 120 may be affixed to or inserted into a frame by various fastening methods. The rear surface 110 can have mounting holes 210 to enable the CEW testing chamber 110 to be affixed to a wall surface 330 by screws 310. The CEW testing chamber 100 may alternatively be affixed to a mounting surface by clamps, brackets or adhesives. The sides of the CEW testing chamber may be made all from the same material or from different types of material. Alternatively the chamber may be formed by an injection molding process or metal forming process. The chamber may be formed a non-conducting material such as wood, NAUF/ULEF MDF board (No Added Urea Formaldehyde Medium Density Fibreboard), a polycarbonate, plastic, or composite material or a metal that is non-conductive or coated with a non-conductive material.

Figure 4A:
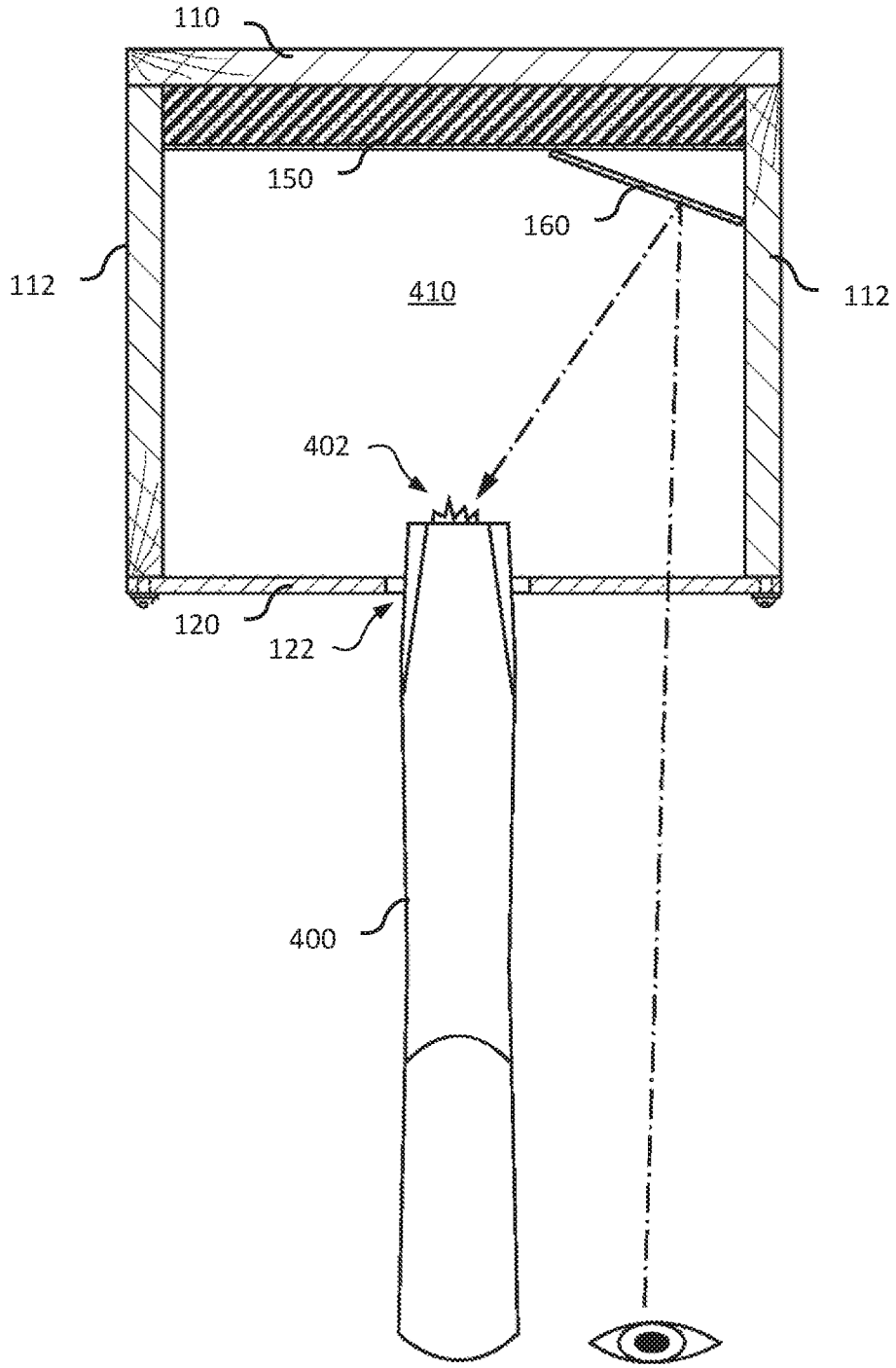
FIG. 4A shows a cross-sectional view of the conducted energy weapon testing chamber with a conducted energy weapon is being tested.

FIG. 4A shows a cross-sectional view of the conducted energy weapon testing chamber with a conducted energy weapon is being tested. The CEW 400 is positioned by an operator in the opening 122 into the interior of the chamber 410. The opening is dimensioned to receive the CEW 400 and limit the possibility that a dart may leave the chamber 410. The CEW 400 can be tested to verify an electrical discharge arcing 402 at the operative end of the CEW 400 by viewing the arcing in the reflective surface 160. The reflective surface 160 can be angled between the absorption surface 150 and an outer wall 112 to provide a viewing angle to the operator. The reflective surface 160 can also be positioned to the side away from the center of the chamber so that any discharge of the darts will not directly impact the reflective surface.

Figure 4B:
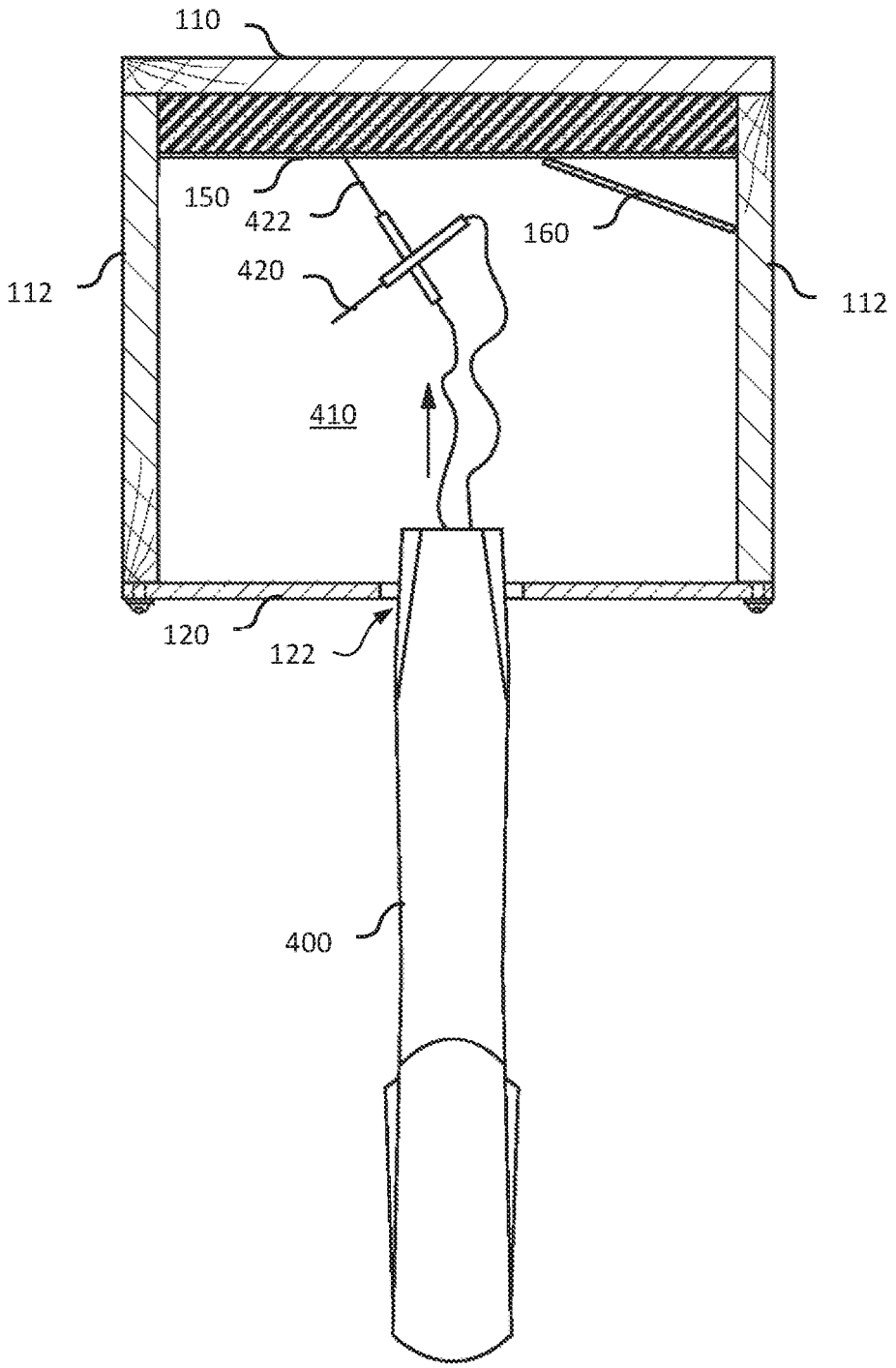
FIG. 4B shows a cross-sectional view of the conducted energy weapon testing chamber with a conducted energy weapon is being tested when a discharge of the darts occurs.

FIG. 4B shows a cross-sectional view of the conducted energy weapon testing chamber 100 with a conducted energy weapon 400 being tested when a discharge of the darts occurs. The darts 420 and 422 can leave the CEW 400 at high velocity and embed in the absorption surface 150. Due to the high velocity the darts 420 and 422 may be deflected and not embed in the absorption surface 150 but are contained within the chamber 410. The CEW 400 may discharge the barbs by operator error or malfunction of the CEW 400 mechanism. The CEW testing chamber 100 provides a safe environment to test the CEW 400 without exposing the operator to potential injury. The electrical discharge is dissipated within the chamber 410. The chamber is made of non-conductive material to contain any electrical discharge. The darts 420 and 422, or probes, can be removed from the chamber by withdrawing the CEW 400 and wires connecting the darts to the CEW 400.

Figure 5:
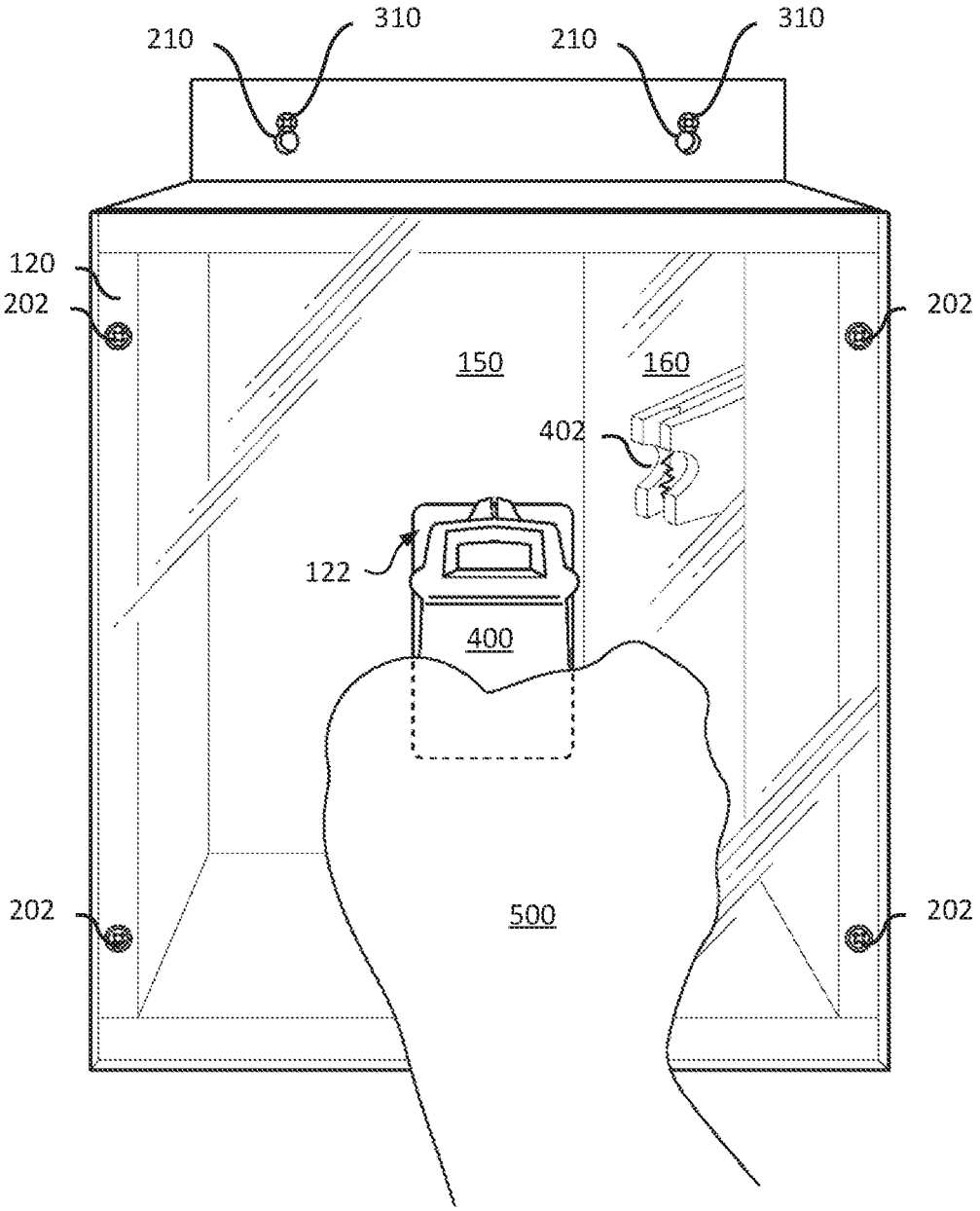
FIG. 5 shows a front view of the conducted energy weapon testing chamber with a conducted energy weapon is being tested.

FIG. 5 shows a front view of the conducted energy weapon testing chamber 100 with a CEW 400 is being tested. In the front view the operators hand 500 grips the CEW 400 and positions the CEW 100 within the opening the CEW testing chamber 100. The arc 402 can be seen from the operative end of the CEW 400 in the reflective surface 160. Alternatively the operator will see if the darts have been accidentally discharged when testing the device.

Figure 6:
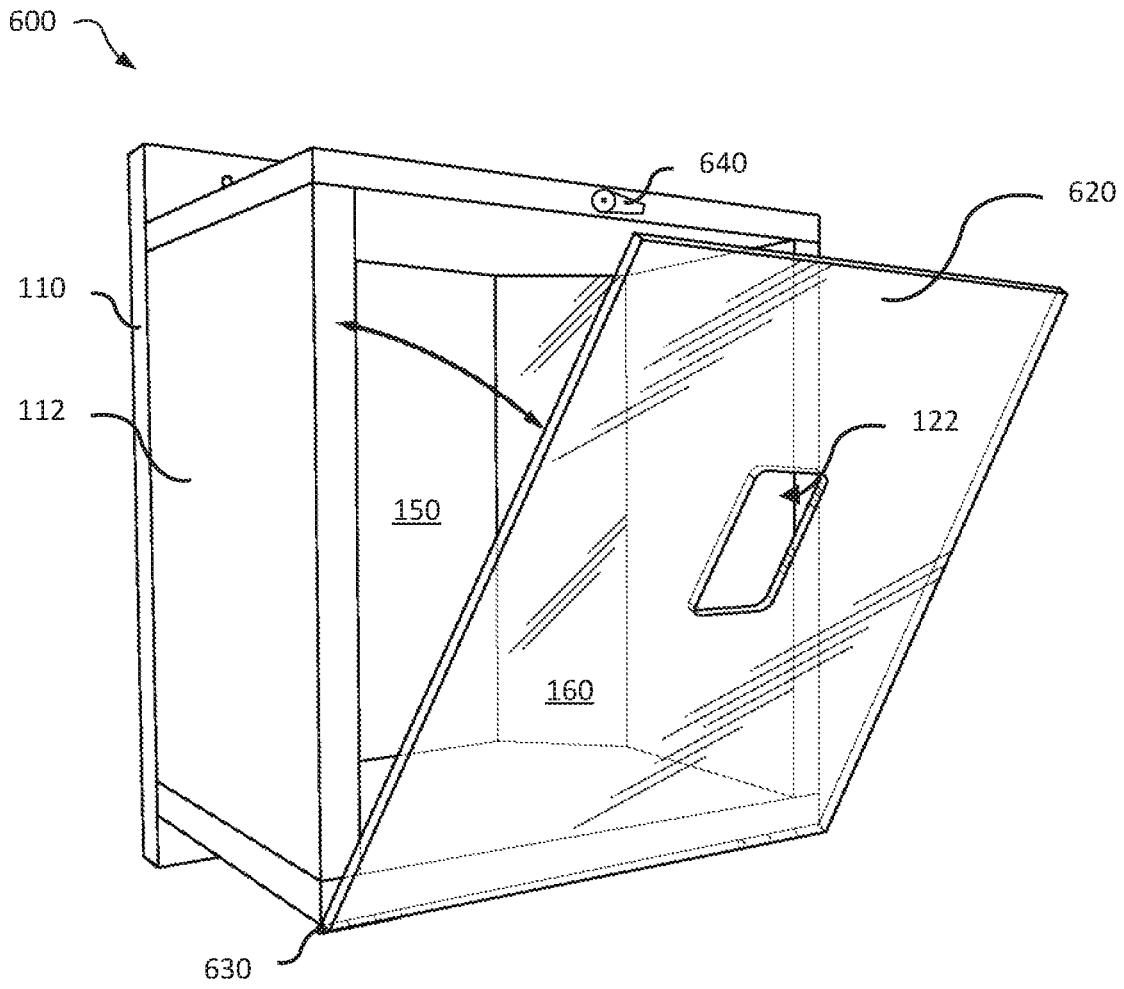
FIG. 6 shows a perspective view of a weapons testing chamber with a hinged cover.
Figure 8:
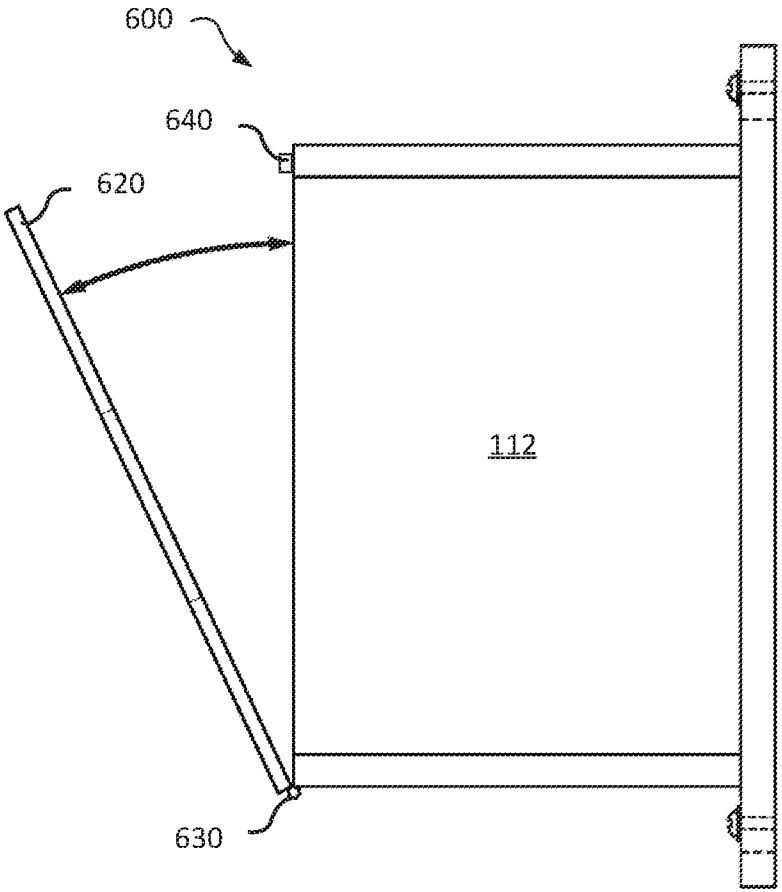
FIG. 8 shows a side view of a weapons testing chamber with a hinged cover.
Figure 7:
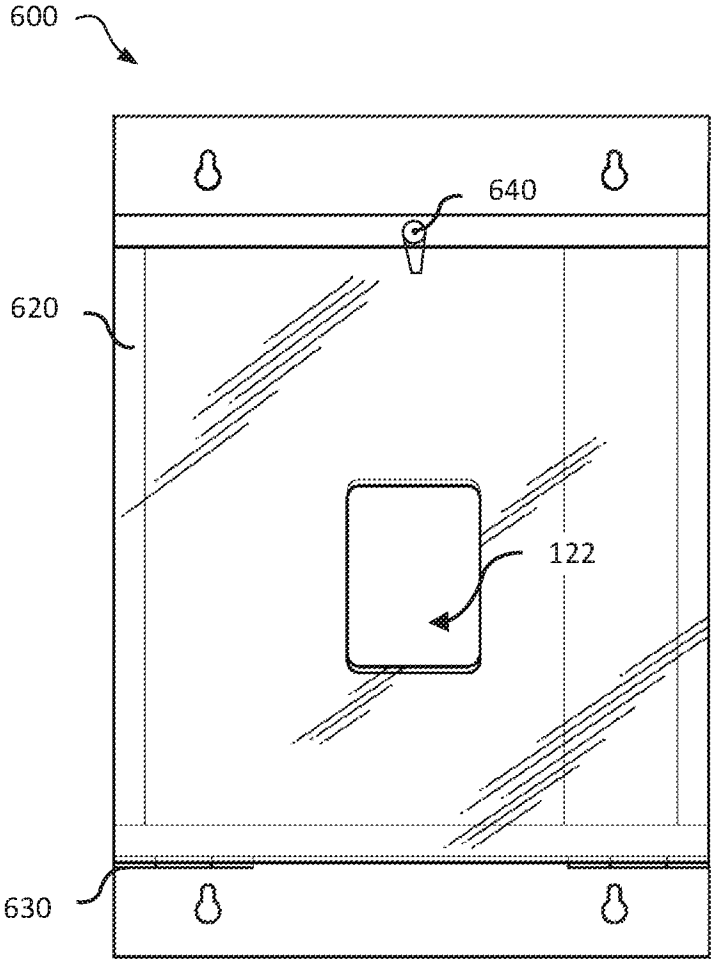
FIG. 7 shows a front view of a weapons testing chamber with a hinged cover.

FIG. 6 shows a perspective view of a weapons testing chamber 600 with a hinged cover. The hinged cover 620 provides easier access to retrieve darts or projectiles from the interior of the chamber. FIG. 7 shows a front view of a weapons testing chamber 600 with a hinged cover, and FIG. 8 shows a side view of a weapons testing chamber 600. A securing mechanism 640 such as a latch or clamp can enable the cover 620 to be secured when the chamber is being utilized. The hinge 630 can be located on any side of the chamber (top, bottom, left, right) with one or more latching mechanisms.

Figure 9:
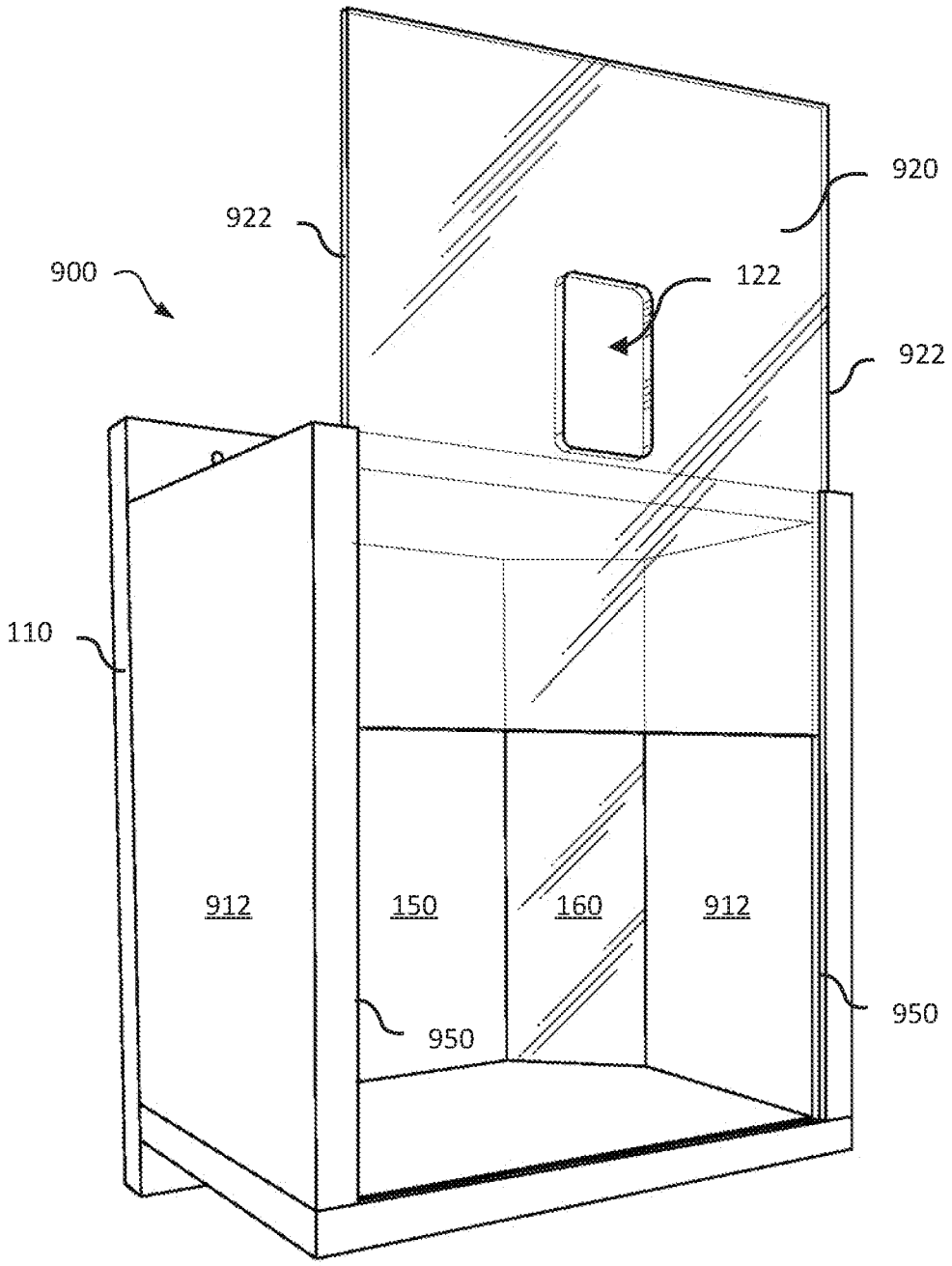
FIG. 9 shows a perspective view of a weapons testing chamber with a sliding cover.
Figure 11:
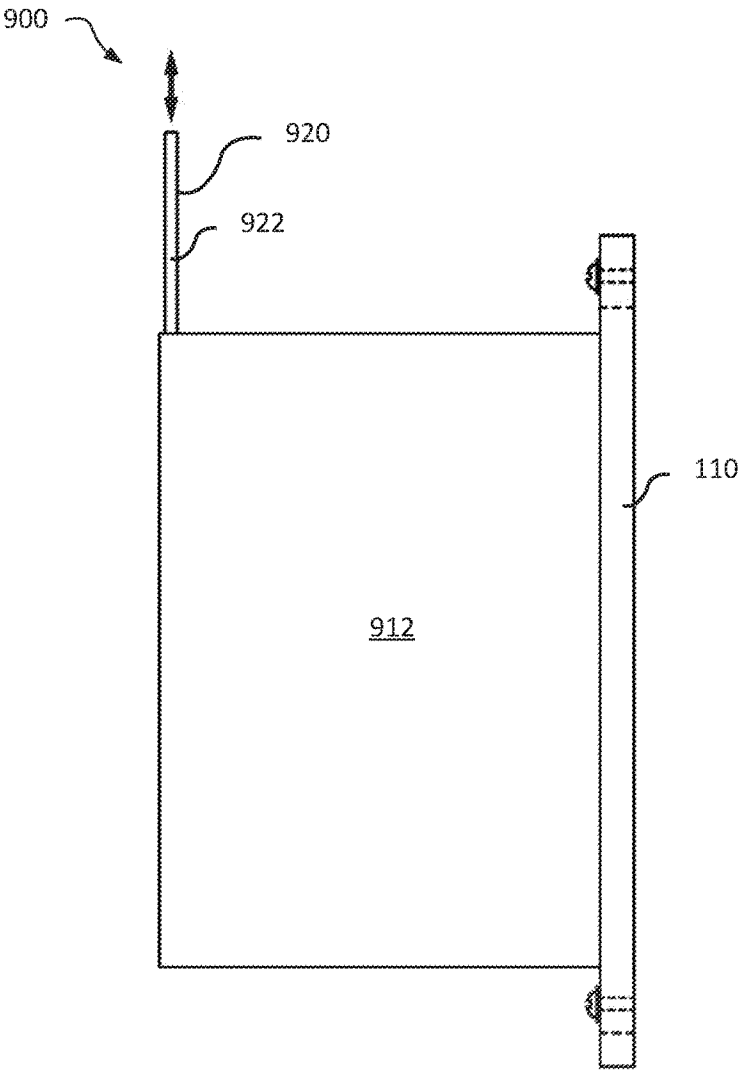
FIG. 11 shows a side view of a weapons testing chamber with a sliding cover.
Figure 10:
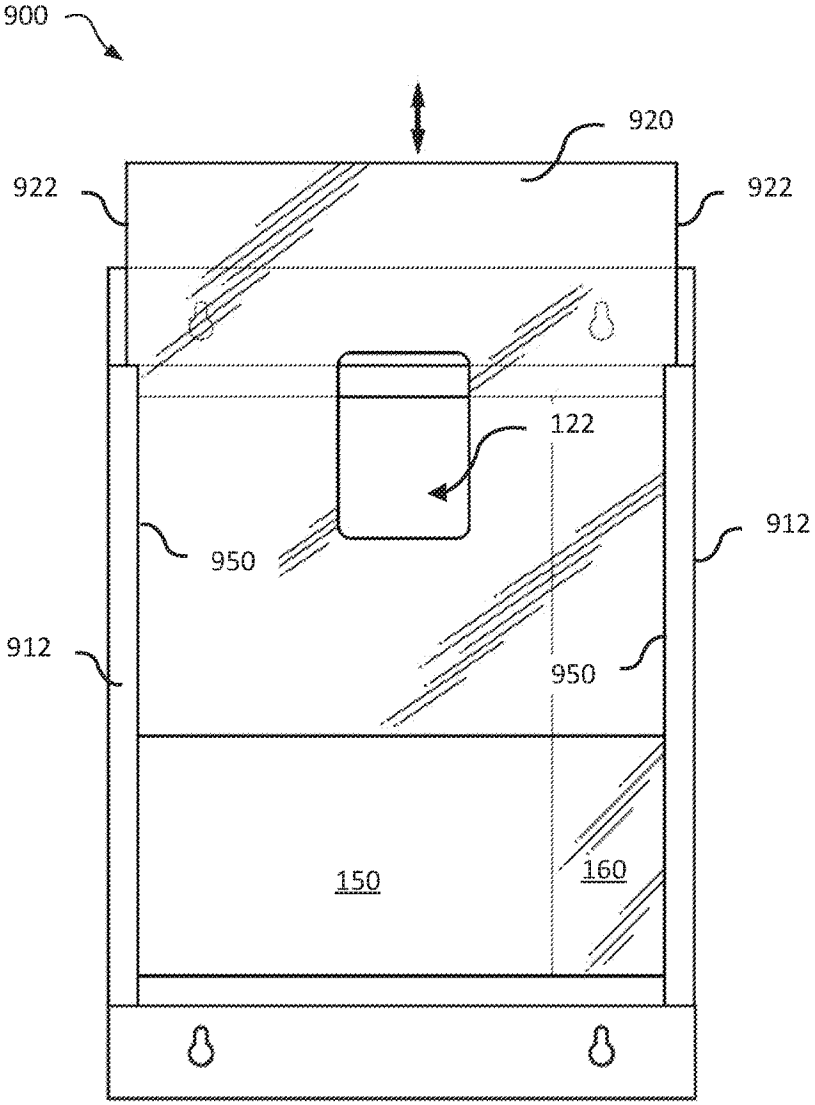
FIG. 10 shows a front view of a weapons testing chamber with a sliding cover.
Figures 12A, 12B, 12C, 12D:
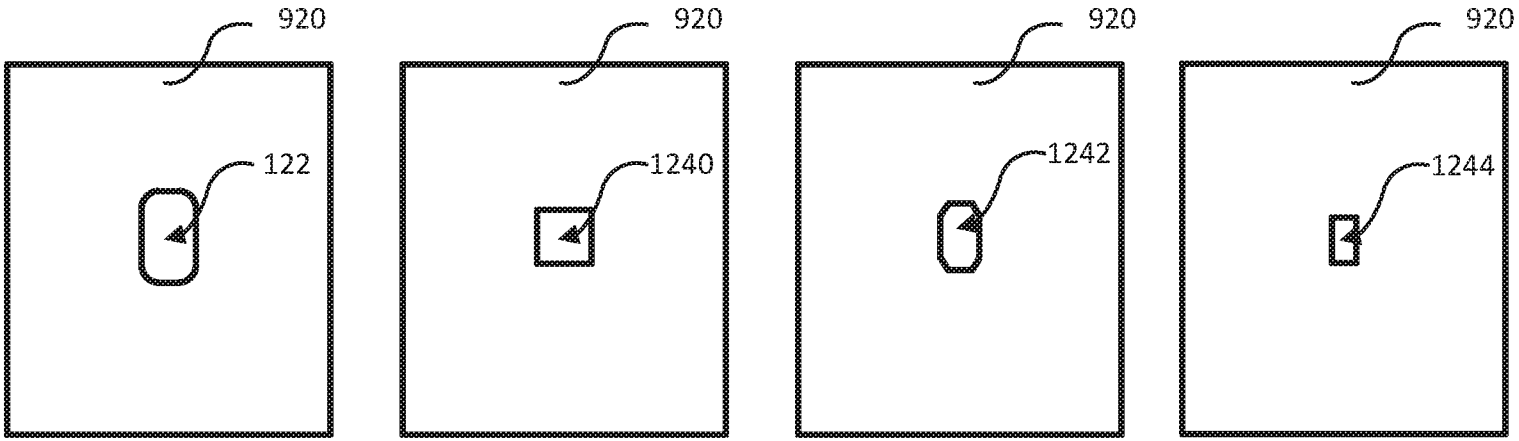
FIGS. 12A-D shows varying sliding cover configurations.

FIG. 9 shows a perspective view of a weapons testing chamber 900 with a sliding cover 920. The edges of the cover 922 can engage with slots 950 in the with the side 912. FIG. 10 shows a front view of the chamber 900 and FIG. 11 shows a side view. The slots may alternatively be at the bottom of the chamber 900 with one or more retention means on the top or sides of the chamber 900. The sliding cover 920 may be removed from the chamber 900 and replaced with different covers having different opening sizes 122 to received the weapon. For example, different CEWs models have different profiles and a handgun profile would be smaller than a CEW.

FIGS. 12A-12D shows examples of the sliding cover 920 with different openings 122, 1240, 1242, 1244. The size and the shape of the opening can vary to accommodate different weapons. For example openings 122, 1240 and 1242 of FIGS. 12A-120 may accommodate different models of CEW weapons and opening 1244 of FIG. 12D may be utilized for firearms which have a smaller front profile. Each of the covers may be made of different materials depending on the type of weapon being utilized. For example material that can withstand ballistic impact may be used for when firearm unloading is performed in the event of a discharge where as a CEW only chamber does will only have to contain CEW projectiles. The differing sizes in profiles reduces the possibility of projectiles passing between the weapon and the cover.

Figure 13:
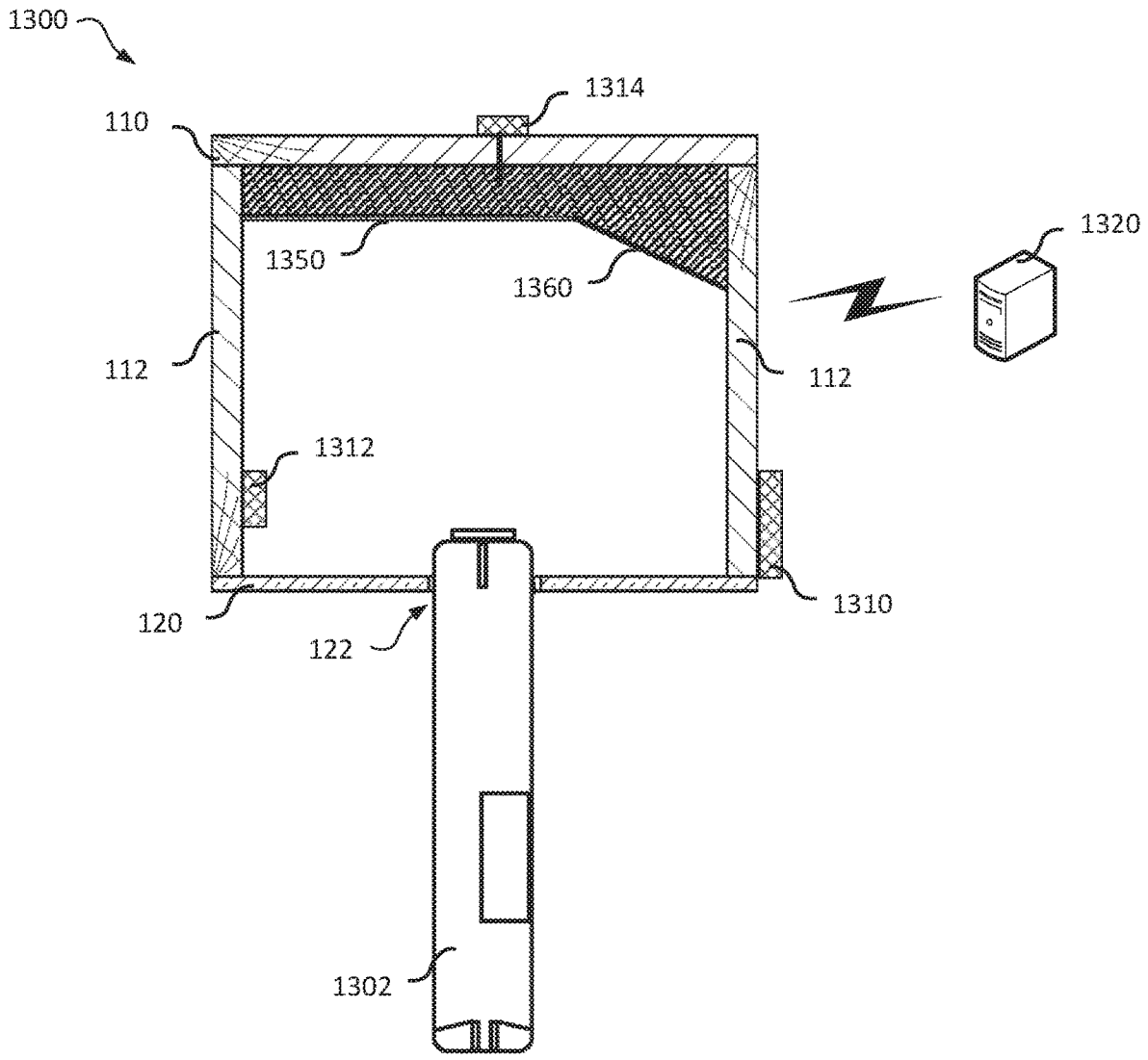
FIG. 13 shows a top view of a weapons testing chamber for CEW testing and handgun verification.

FIG. 13 shows a top view of a weapons chamber 1300 for CEW testing or handgun verification. In this embodiment, the weapons chamber 1300 can also operate as a handgun unloading system to mitigate the impact of an accidental discharge and to ensure the chamber of the handgun is empty in addition to CEW testing. Similarly to the CEW testing, the barrel of the handgun 1302 is placed within the opening 122 of the cover 120 and the clearance of the handgun chamber can be safely verified by the user. The chamber provides an absorption surface 1350 is provided that in additional to absorbing the impact of a CEW projectile, is capable of containing a bullet impact safely without deflecting the bullet. The absorption surface 1350 may comprise materials such as, but not limited to, Kevlar™, ballistic nylon, shredded soft body armour or ballistic rubber when utilized for firearm unloading. The absorption surface may comprise multiple layers of material with differing properties to accommodate different types of weapons with the same weapons chamber.

An angled portion 1360 of the absorption surface 1350 may also provide a reflective surface for viewing the barrel of the weapon, however the reflective surface of the angled portion 1360 can be place on top of the absorption surface 1350 to allow for absorption of an impact. Although the reflective surface has been illustrated as being provided vertically it may be provided as a horizontal surface within the chamber but may also be provided by a spherical reflecting surface.

Sensors may be provided with the chamber to confirm proper procedures are followed, to detect or confirm discharges, or identify a user or a particular weapon being used. For example a radio frequency identifier (RFID), Near Field Communication (NFC) or QR code scanner 1310 may be utilized to identify the user or the weapon. The chamber 1300 may also include one or more sensors 1314 or a camera 1312 to detect a discharge or impact. A camera 1312 may be utilized to verify a discharge or record usage of the chamber. If an accidental discharge does occur, a notification can be provided to identify that the chamber should be inspected for possible damage or replacement. The sensors can be directly coupled or wirelessly coupled to a computing device 1320 to record information from the chamber 1300. Alternatively, or additionally, a QR code may be provided on the exterior of the chamber to enable a user to check-in for verification and to confirm that verification or clearance procedures have been performed. The chamber and cover may be made of a material capable of withstanding a projectile such as a bullet, for example it may be made of metal or bullet resistant polycarbonate materials.

Figure 14:
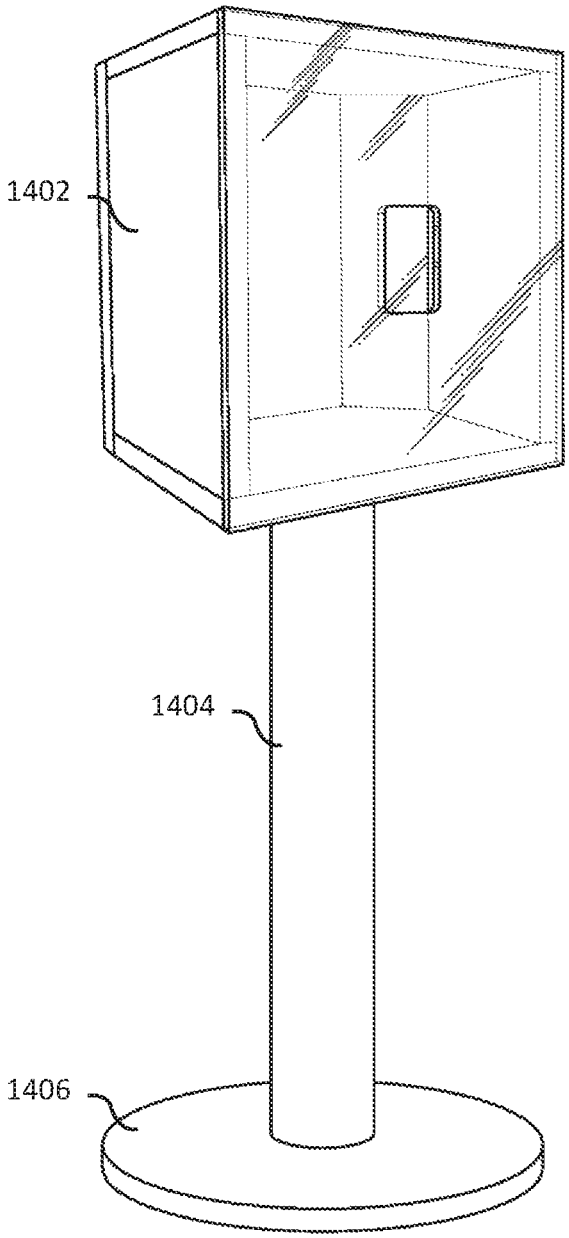
FIG. 14 shows a pedestal mount for weapons testing chamber.

FIG. 14 shows an alternate mounting for the weapons chamber 1400 on a pedestal mount. The weapons chamber 1402 can be mounted on a stand 1404 coupled to a base 1406 forming the pedestal mount. The base 1406 provides appropriate weight to maintain stability of the chamber during use if an accidental discharge occurs.

It would be appreciated by one of ordinary skill in the art that the system and components shown in FIGS. 1-14 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims. Numerous additional variations on the apparatus of the various embodiments described above will be apparent to those skilled in the art in view of the above description. Such variations are to be considered within the scope.

The invention claimed is:

1. A weapon testing chamber comprising:

a plurality of sides forming a chamber;

a removable cover on one side of the chamber, having an opening there through, for receiving an operative end of a weapon pointed into the chamber, the removable cover retained by at least two sides of the plurality of sides forming the chamber having respective receiving slots provided therein;

an absorption surface opposite of the cover within the chamber on at least one of the plurality of sides for receiving or absorbing a projectile if propelled from the weapon; and a reflective surface within the chamber to enable an operator to view an end of the weapon inserted within the opening;

wherein the absorption surface contains the projectile when discharged from the weapon and the removable cover can be removed by to retrieve the projectiles.

2. The weapon testing chamber of claim 1 wherein the plurality of sides is made of one or more selected group the group comprising a polycarbonate, plastic, composite or metal.

3. The weapon testing chamber of claim 1 wherein at least a portion of the viewing cover is a transparent surface.

4. The weapon testing chamber of claim 3 wherein the transparent surface is formed by an acrylic glass or polycarbonate material.

5. The weapon testing chamber of claim 1 wherein the reflective surface is acrylic mirror.

6. The weapon testing chamber of claim 1 wherein the reflective surface is positioned off-centre of the opening.

7. The weapon testing chamber of claim 1 wherein the reflective surface is angled relative to the absorption surface and a perpendicular side of the plurality of sides of the chamber.

8. The weapon testing chamber of claim 1 wherein the absorption surface comprises one or more layers of material.

9. The weapon testing chamber of claim 8 wherein the one or more layers of material comprises one or more of nylon, Kevlar™, rubber, Cordura® and foam.

10. The weapon testing chamber of claim 9 wherein the weapon is a handgun.

11. The weapon testing chamber of claim 10 wherein at least a portion of the viewing cover is a transparent surface and is bullet-resistant.

12. The weapon testing chamber of claim 11 wherein the reflective surface is acrylic mirror.

13. The weapon testing chamber of claim 10 wherein the absorption surface comprises shredded body armour.

14. The weapon testing chamber of claim 10 further comprising one or more sensors located inside the chamber to detect a discharge.

15. The weapon testing chamber of claim 1 further comprising a scanning device for detecting an identifier associated with the weapon, wherein the scanning device provides the identifier to a remote server.

16. The weapon testing chamber of claim 1 further comprising a scanning device for detecting an identifier associated with a use of the weapon, wherein the scanning device provides the identifier to a remote server.

17. The weapon testing chamber of claim 1 wherein the weapon is a conducted energy weapon (CEW).

18. The weapon testing chamber of claim 1 wherein the chamber is mounted on a pedestal.

19. The weapon testing chamber of claim 1 wherein one of the plurality of sides is mountable to an exterior surface.

* * * * *